US006799593B2

(12) United States Patent
Kendro, Jr.

(10) Patent No.: US 6,799,593 B2
(45) Date of Patent: Oct. 5, 2004

(54) TRANSPORTABLE ROTATABLE WEATHER SHIELD

(76) Inventor: Albert Kendro, Jr., 294 Iven Ave., 3-C, St. Davids, PA (US) 19087-6692

( * ) Notice: Subject to any disclaimer, the term of this patent is extended or adjusted under 35 U.S.C. 154(b) by 0 days.

(21) Appl. No.: 09/949,582

(22) Filed: Sep. 10, 2001

(65) Prior Publication Data

US 2002/0029528 A1 Mar. 14, 2002

Related U.S. Application Data

(60) Provisional application No. 60/231,586, filed on Sep. 11, 2000.

(51) Int. Cl.[7] ..... E04H 15/00; E04H 15/62

(52) U.S. Cl. ..... 135/95; 135/120.4; 135/128; 52/4; 52/23; 52/222

(58) Field of Search ..... 135/95 Y, 96, 135/118, 117, 115, 120.4, 124, 128, 157, 908, 900, 902; 52/2.25, 2.26, 23, 83, 222, 3, 4, 5, 6, 173.3, 660; 482/35; 297/248

(56) References Cited

U.S. PATENT DOCUMENTS

| | | | | | |
|---|---|---|---|---|---|
| 2,142,851 | A | * | 1/1939 | Jolly | 135/128 |
| 2,266,853 | A | * | 12/1941 | Dabney | 135/124 |
| 3,265,059 | A | * | 8/1966 | Matthews | 135/128 |
| 3,800,468 | A | | 4/1974 | De Graff | |
| 3,929,145 | A | * | 12/1975 | Schroeder | 135/1 R |
| 3,954,236 | A | * | 5/1976 | Brown | 244/155 R |
| 3,970,096 | A | * | 7/1976 | Nicolai | 135/14 |
| 4,030,748 | A | * | 6/1977 | Brock | 297/184 |
| 4,096,874 | A | * | 6/1978 | Weatherly | 135/5 R |
| 4,440,187 | A | * | 4/1984 | Fiddler | 135/117 |
| 4,953,576 | A | * | 9/1990 | Connelly | 135/118 |
| 5,080,123 | A | | 1/1992 | Stein | |
| 5,240,021 | A | * | 8/1993 | Snodgrass | 135/96 |
| 5,319,896 | A | * | 6/1994 | Winger | 52/23 |
| 5,343,887 | A | * | 9/1994 | Dannaher | 135/104 |
| 5,522,184 | A | * | 6/1996 | Oviedo-Reyes | 52/23 |
| 5,575,301 | A | | 11/1996 | Bolton | |
| 5,579,794 | A | * | 12/1996 | Sporta | 135/88.01 |
| 5,791,090 | A | * | 8/1998 | Gitlin et al. | 52/4 |
| 5,819,477 | A | * | 10/1998 | Gaffney | 52/23 |
| 5,901,726 | A | * | 5/1999 | Gall et al. | 135/120.3 |
| 5,927,311 | A | | 7/1999 | Jager | |
| 5,950,649 | A | | 9/1999 | Gerig | |
| 5,967,162 | A | | 10/1999 | Bolton | |
| 6,019,112 | A | * | 2/2000 | Matlock | 135/124 |
| 6,109,281 | A | * | 8/2000 | Lowenthal | 135/125 |
| 6,289,910 | B1 | * | 9/2001 | Zheng | 135/125 |
| 6,330,889 | B1 | * | 12/2001 | Overton | 135/95 |
| 2002/0029795 | A1 | * | 3/2002 | Zheng | 135/125 |

FOREIGN PATENT DOCUMENTS

| | | | | |
|---|---|---|---|---|
| CH | 000392791 | * | 10/1965 | 135/124 |
| FI | 000036730 | * | 1/1968 | 135/124 |
| FR | 0739049 | * | 1/1933 | 135/95 |
| FR | 1204688 | * | 1/1960 | 135/124 |
| GB | 0551441 | * | 2/1943 | 135/95 |

OTHER PUBLICATIONS

Kwikgoal 2001 Soccer Equipment & Supplies, Cover and pp. 1, 25.
www.kwikgoal.com/seating.php, pp. 1–4, (Nov. 19, 2001).
www.kwikgoal.com/9b301.html, pp. 1–2, (Nov. 19, 2001).
www.kwikgoal.com/9b601.html, pp. 1–2, (Nov. 19, 2001).
www.kwikgoal.co/9b31801.html, p. 1, (Nov. 19, 2001).

* cited by examiner

*Primary Examiner*—Phi Dieu Tran A
(74) *Attorney, Agent, or Firm*—Akin Gump Strauss Hauer & Feld, LLP

(57) ABSTRACT

The present invention is a transportable weather shield having a sheet, first and second supports, first and second tensioners, and first and second stakes. The first support has an upper portion that is connected to a first end of the sheet and a generally arcuate-shaped lower portion. The first tensioner is connected to the first end of the sheet and to the first stake. The second support has an upper portion that is connected to the second end of the sheet and a generally arcuate-shaped lower portion. The second tensioner is connected to the second end of the sheet and to the second stake. The weather shield, upon erection, is compliant. A position of the sheet is adjustable by an angular displacement of the first and second supports.

6 Claims, 8 Drawing Sheets

TRANSPORTABLE ROTATABLE WEATHER SHIELD

CROSS REFERENCE TO RELATED APPLICATIONS

This application is related to Provisional Application No. 60/231,586 filed Sep. 11, 2000 and claims the earlier filing date of the provisional application under 35 U.S.C. 119(e).

BACKGROUND OF THE INVENTION

The present invention relates to a transportable, rotatable weather shield. More particularly, the present invention relates to a weather shield having an adjustable position relative to the movement of the sun, and the direction of wind and rain. Conventional tarps and canopies typically used to shield people and articles from exposure to the elements are generally fixed structures. When conventionally erected at outdoor events, the typical canopy or tarp is generally supported by poles that are kept erect by guidelines attached to stakes driven in the ground. Such structures generally have at least four corner poles and a center pole. Once erected, shields of this type cannot be readily repositioned to accommodate changes in the weather or to change the amount of shade they create. Additionally, if such structures are erected at athletic events in close proximity to the sidelines of the playing field a safety hazard for players, coaches and spectators may be created.

The present invention, by providing a rotatable, compliant support structure, permits the erection of a canopy in close proximity to playing field sidelines to shield players and equipment from the elements. The canopy is adjustable to accommodate changes in the position of the sun and the direction of wind and rain.

While the primary utility of the present invention is to shield players and equipment from the vagaries of the weather, the weather shield has been found to have secondary utility. In particular, the weather shield creates a space that separates occupants from distractions occurring in the surrounding environment. Additionally, under certain circumstances, air circulation under the shield increases. Alternatively, or concurrently with use as a weather shield, the present invention may be used as a transportable billboard for advertisers, sponsors and sports teams or the organizations they represent. For instance, the shield could be used at parties and other social events to protect equipment, people or food from the environment.

BRIEF SUMMARY OF THE INVENTION

One aspect of the present invention is a transportable weather shield comprising a sheet, first and second supports, first and second tensioners, and first and second stakes. The sheet has a first end and a second end spaced from and opposed to the first end. The first support has an upper portion and a generally arcuate-shaped lower portion. The upper portion of the first support is connected to the first end of the sheet. The first tensioner has a first end and a second end. The first end of the first tensioner is connected to the first end of the sheet. The first stake is connected to the second end of the first tensioner. The second support has an upper portion and a generally arcuate-shaped lower portion. The upper portion of the second support is connected to the second end of the sheet. The second tensioner has a first end and a second end. The first end of the second tensioner is connected to the second end of the sheet. The second stake is connected to the second end of the second tensioner. The weather shield, upon erection, is compliant. A position of the weather shield is adjustable by an angular displacement of the first and second supports.

In another aspect of the present invention a transportable weather shield comprises a sheet, first and second generally oval-shaped tubular hoops, first and second tensioners and first and second stakes. The sheet has a first end and a second end spaced from and opposed to the first end. The first end of the sheet has a first sleeve and a first plurality of spaced-apart tabs peripheral to the first sleeve. Each tab of the first plurality of spaced-apart tabs has a grommet. The second end of the sheet has a second sleeve and a second plurality of spaced-apart tabs peripheral to the second sleeve. Each tab of the second plurality of spaced-apart tabs has a grommet. The first generally oval-shaped tubular hoop has an upper portion and a lower portion. The upper portion is contained in the first sleeve. The first tubular hoop comprises a first plurality of separable segments. The first tensioner comprises a first link and a first plurality of elastic members. The first link comprises a first ring and a first web having a first end and a second end spaced an adjustable first length from the first end. The first end is connected to the first ring. Each elastic member of the first plurality of elastic members has a first end and a second end. The first end of each elastic member is removably connected to the grommet of a corresponding tab of the first plurality of spaced-apart tabs peripheral to the first sleeve of the first end of the sheet. The second end of each elastic member is removably connected to the first ring of the first link. The first stake is removably connected to the second end of the first web of the first link. The second generally oval-shaped tubular hoop has an upper portion and a lower portion. The upper portion is contained in the second sleeve. The second tubular hoop comprises a second plurality of separable segments. The second tensioner comprises a second link and a second plurality of elastic members. The second link comprises a second ring and a second web having a first end and a second end spaced an adjustable second length from the first end. The first end is connected to the second ring. Each elastic member of the second plurality of elastic members has a first end and a second end. The first end of each elastic member is removably connected to the grommet of a corresponding tab of the second plurality of spaced-apart tabs peripheral to the second sleeve of the second end of the sheet. The second end of each elastic member is removably connected to the second ring of the second link. The second stake is removably connected to the second end of the second web of the second link.

Still another aspect of the invention is a transportable weather shield comprises a sheet, first, second and third supports, first and second tensioners and first and second stakes. The sheet has a first end and a second end spaced from and opposed to the first end. The first end of the sheet has a first sleeve. The second end of the sheet has a second sleeve. The first support has an upper portion and a generally arcuate-shaped lower portion. The upper portion of the first support is contained in the first sleeve. The first tensioner has a first end and a second end. The first end of the first tensioner is connected to the first end of the sheet. The first stake is connected to the second end of the first tensioner. The second support has an upper portion and a generally arcuate-shaped lower portion. The upper portion of the second support is contained in the second sleeve. The second tensioner has a first end and a second end. The first end of the second tensioner is connected to the second end of the sheet. The second stake is connected to the second end of the second tensioner. A third sleeve is integral with the sheet.

The third sleeve is spaced between the first and second sleeves. The third support has an upper portion and a generally arcuate-shaped lower portion. The upper portion of the third support is contained in the third sleeve. The weather shield, upon erection, is compliant. A position of the weather shield is adjustable by an angular displacement of the first, second and third supports.

BRIEF DESCRIPTION OF THE SEVERAL VIEWS OF THE DRAWINGS

The foregoing summary, as well as the following detailed description of the presently preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
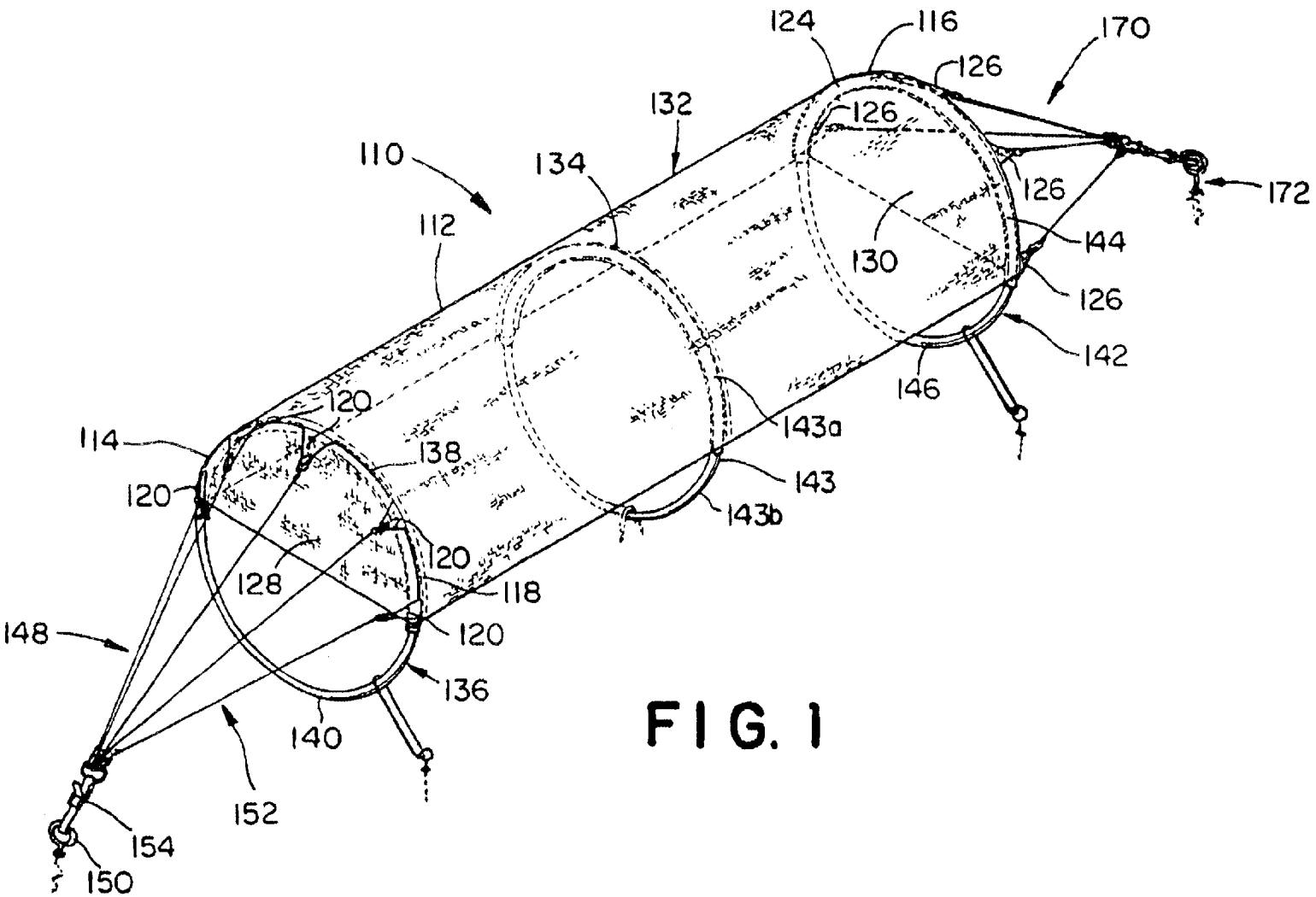
FIG. 1 is a perspective view of a transportable, rotatable weather shield in accordance with a first preferred embodiment of the present invention.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the weather shield and designated parts thereof. The terminology includes the words above specifically mentioned, derivatives thereof and words of similar import.

Figure 2:
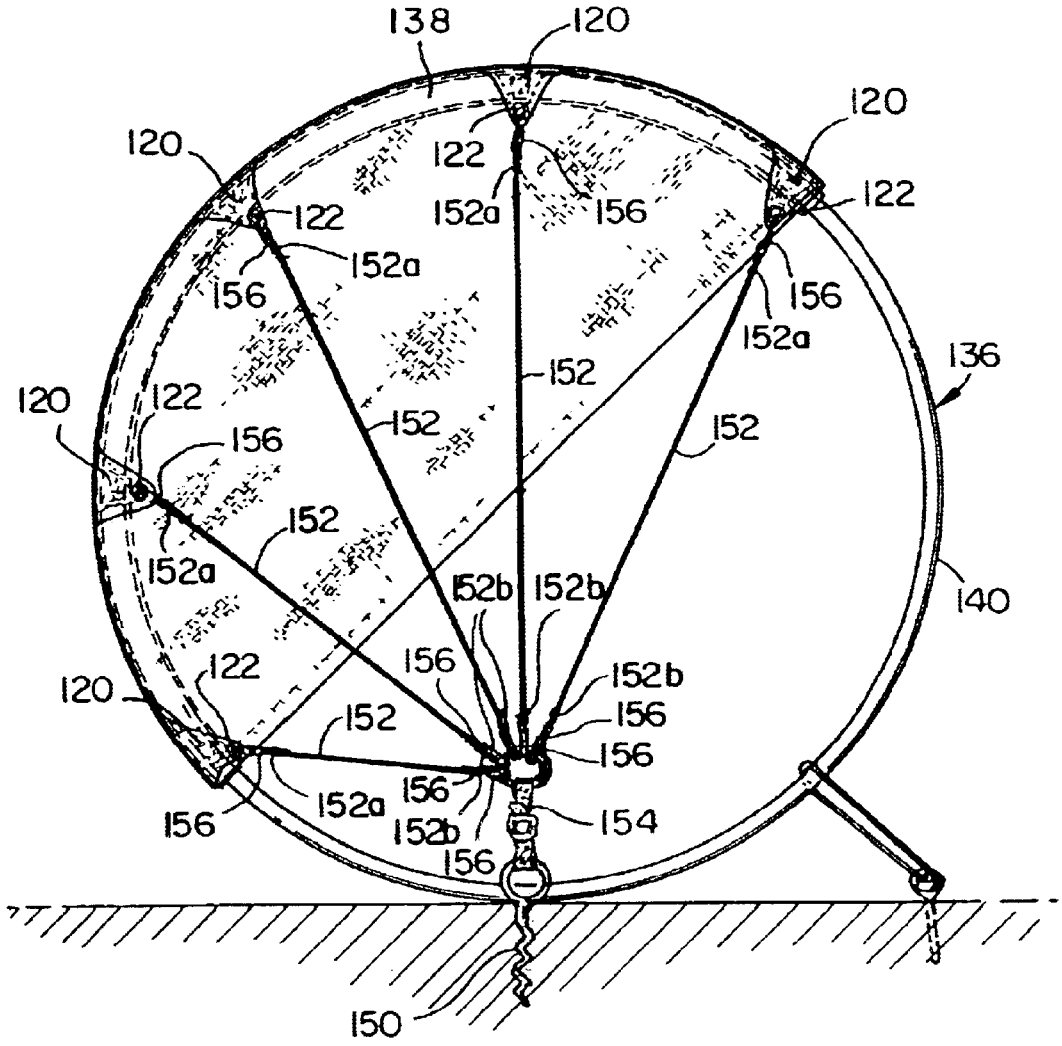
FIG. 2 is a left side elevational view of the weather shield of FIG. 1 rotated approximately forty-five degrees counter clockwise.
Figure 3:
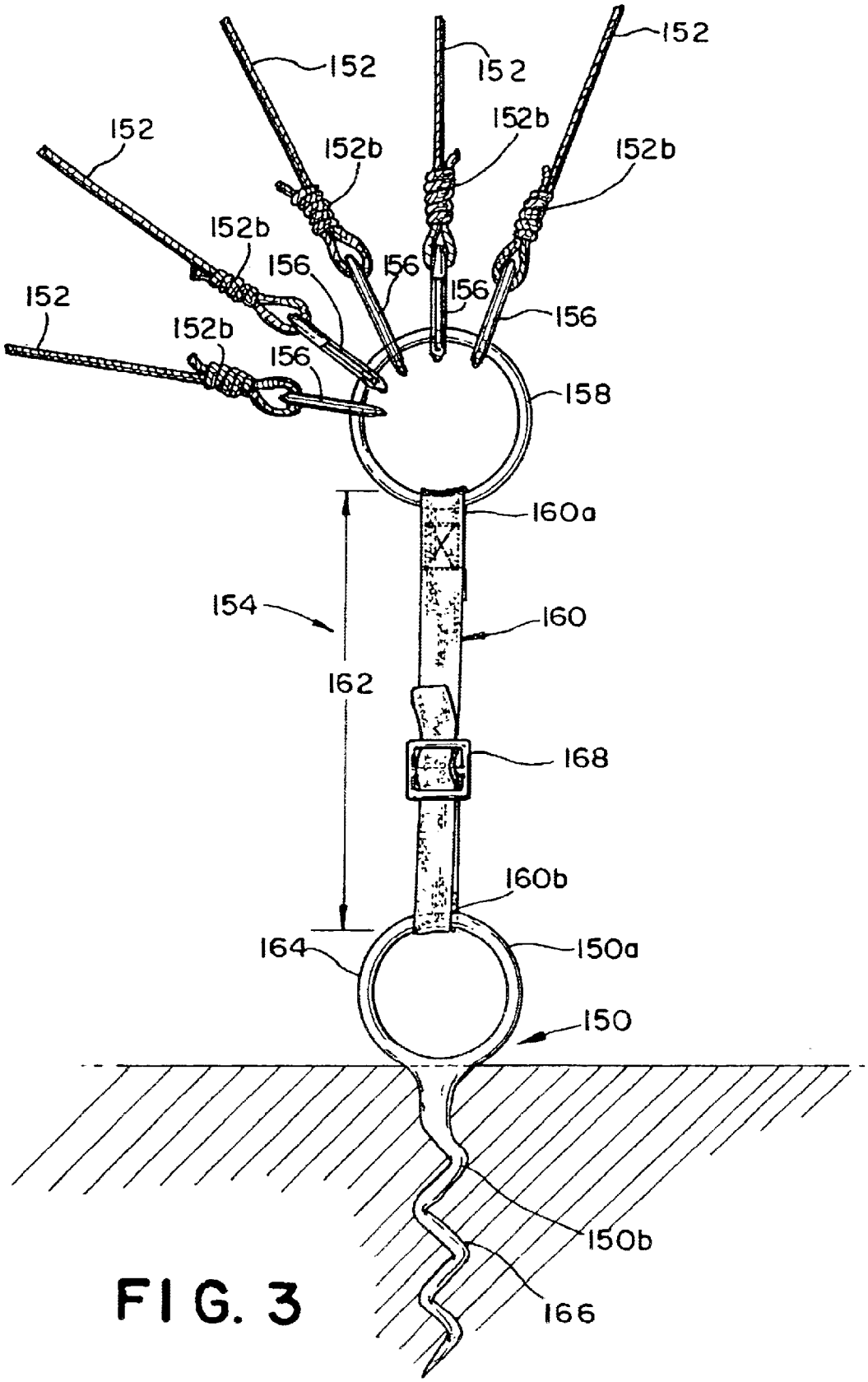
FIG. 3 is a left side elevational view, partially in cross-section, of a tensioner and stake showing the attachment of hooks attached to the lower end of the elastic members of the weather shield of FIG. 2.

Referring to the drawings in detail, were like numerals indicate like elements throughout there is shown in FIGS. 1 through 3 a first preferred embodiment of the transportable weather shield, generally designated 110 and hereinafter referred to as the "weather shield" 110, in accordance with the present invention. The weather shield 110 includes a sheet 112 having a first end 114 and a second end 116 spaced from and opposed to the first end 114. Preferably, the first end 114 of the sheet 112 has a first sleeve 118 and a first plurality of spaced-apart tabs 120 peripheral to the first sleeve 118. Preferably, the first plurality of tabs 120 is at least five in number. However, those skilled in the art will understand that the number of tabs may be less than five in number or greater than five in number without departing from the scope of the invention. Each tab of the first plurality of spaced-apart tabs 120 preferably has a grommet 122. The second end 116 of the sheet 112 has a second sleeve 124 and a second plurality of spaced-apart tabs 126 peripheral to the second sleeve 124. Each tab of the second plurality of spaced-apart tabs 126 has a grommet 122.

Preferably, a first side panel 128 having the general shape of a semi-circle is integral with the first end 114 and a second side panel 130 having the general shape of a semi-circle is integral with the second end 116. The sheet 112 together with the first and second side panels 128, 130 form a canopy 132 having the general shape of semi-cylinder having a generally semi-circular cross section and closed ends. The semi-cylinder preferably has a diameter of approximately six (6) feet and an axial length of approximately twenty (20) feet. Preferably, the canopy 132 has a third sleeve 134 integral with the sheet 112 and spaced between the first and second sleeves 118, 124. Those skilled in the art will understand from the present disclosure that the first and second side panels 128, 130 can be removably attached to the sheet 112 by any of a variety of well-known fasteners such as zippers or snaps without departing form the scope of the invention. Further, the artisan will understand that the canopy 132 may have a plurality of sleeves between the first and second sleeves 118, 124 and that the number of sleeves will depend on the overall axial length of the canopy 132. Still further, the artisan will understand that sleeves should be spaced approximately ten (10) feet apart., to prevent the sheet 112 from sagging The canopy 132 is preferably made from a lightweight, ultra violet resistant nylon, such as Solarmax™ nylon sold by E. I. du Pont de Nemours and Company of Wilmington, Del. However, those skilled in the art will recognize from the present disclosure that the sheet 112 is not restricted to a specific shape, size, or material. Broadly, the invention pertains to weather shields having a sheet 112 in a general arcuate shape with side panels having a corresponding perimeter. Similarly, those skilled in the art will recognize that the sheet 112 and side panels 128, 130 may be of arbitrary size and may be fabricated from any fabric suitable for outdoor application. Alternatively, the side panels 128, 130 can be constructed of a mesh or breathable material to allow cross ventilation underneath the weather shield 110. Further the artisan will understand that the first, second and third sleeves 118, 124, 134 and the first and second pluralities of tabs 120, 126 may be fabricated from the same material as the sheet 112 or may be a different material. Still further, the artisan will understand that the tabs 120 serve as points of attachment for the tensioners discussed below and that any structure, such as a plurality of cutouts forced if desired, in the first and second sleeves 118, 124, that facilitates access to the supports also discussed below may replace the first and second plurality of tabs 120, 126.

The weather shield 110 includes a first support 136 having an upper portion 138 and a generally arcuate-shaped lower portion 140. The first support 136 preferably is a generally oval-shaped first tubular hoop. The upper portion 138 of the first support 136 is connected to the first end 114 of the sheet 112. Preferably, the first sleeve 118 contains the upper portion 138 of the first support 136.

The weather shield 110 additionally includes a second support 142 substantially the same as the first support 136. The second support 142 has an upper portion 144 and a generally arcuate-shaped lower portion 146. The second support 142 preferably is a generally oval-shaped second tubular hoop. The upper portion 144 of the second support 142 is connected to the second end 116 of the sheet 112. Preferably, the second sleeve 124 contains the upper portion 144 of the second support 142.

Preferably, the weather shield 110 has a third support 143 substantially the same as the first and second supports 136, 142. The third support 143 has an upper portion 143*a* in the third sleeve 134 and a generally arcuate-shaped lower portion 143*b*. Those having ordinary skill in the art will understand from the present disclosure that the weather shield 110 may have a plurality of supports corresponding to the plurality of sleeves the canopy 132 may have and that each support is similar to the first and second supports 136, 142. Accordingly, in the interest of brevity, the third support, as well as any additional supports, will not be further described.

As will become apparent from the second preferred embodiment discussed below, those having ordinary skill in the art will understand from the disclosure below that the first and second supports 136, 142 may respectively comprise a first and second plurality of separable segments without departing from the scope of the invention. Further, the artisan will understand that the preferred number of separable segments is approximately four separable segments. However, the number of separable segments could be more or less than four without departing from the scope of the invention. Still further, the artisan will understand that the separable segments, if any, can be removably connected by any well known coupling method such as a sleeve into which opposed ends of the corresponding segments are inserted or by adapting the opposed ends to allow the insertion of one end of a segment into the opposed end of a corresponding segment. It is also understood by those of ordinary skill in the art, that the segments can be releasably secured through an interlock mechanism, such as a compressible button on one segment and a corresponding hole on an adjacent segment (e.g., detent) (not shown).

The first and second supports 136, 142 are preferably made from a light weight, aircraft aluminum tubing. However, those skilled in the art will recognize from the present disclosure that the first and second supports 136, 142 are not restricted to a specific material. Broadly, the invention pertains to weather shields having first and second supports 136, 142 fabricated from any structural material suitable for outdoor application including other metals such as steel and titanium and polymeric materials in general.

The weather shield 110 includes a first tensioner 148 having a first end and a second end. The first end of the first tensioner 148 is connected to the first end 114 of the sheet 112 and the second end of the first tensioner 148 is connected to a first stake 150 as discussed below. Preferably, the first tensioner 148 comprises a first plurality of elastic members 152 and a first link 154. The first plurality of elastic members 152 corresponds in number to the number of tabs comprising the first plurality of tabs 120 peripheral to the first sleeve 118. Each elastic member of the plurality of elastic members 152 has a first end 152*a* and a second end 152*b*. The plurality of first ends 152*a* corresponds to the first end of the first tensioner 148. Preferably, the first end 152*a* of each elastic member is removably connected to the grommet 122 of a corresponding tab of the first plurality of spaced-apart tabs 120 peripheral to the first sleeve 118 of the first end 114 of the sheet 112. Preferably, the first and second ends 152*a*, 152*b* of each member of the plurality of elastic members 152 terminates in a fastener 156 that is removably insertable in the grommets 122 of the first plurality of tabs 120 to secure the first tensioner 148 to the first end 114 of the sheet 112. Those having ordinary skill in the art will understand form the present disclosure that the fasteners 156 can be any well known fastener such as a carabiner, a hook or the like.

The first link 154 has a first ring 158 and a first web 160. The first ring 158 is removably connected, preferably by fasteners 156, to the second end 152*b* of each elastic member of the first plurality of elastic members 152. The first web 160 has a first end 160*a* and a second end 160*b* spaced an adjustable first length 162 from the first end 158*a*. The first end 160*a* is connected to the first ring 158. Preferably, the first end 160*a* is fixedly attached to the first ring 158 by looping the web about the first ring 158 and securing by stitching the looped web to itself. Those having ordinary skill in the art will understand that any well known manner of securing the first end 160*a* of the first web 160 to itself such as by rivets or adhesive or fusion bonding is acceptable without departing form the scope and spirit of the invention. Still further, the artisan will understand that the first end 160*a* of the first web 160 may be secured to the first ring 158 by any conventional fastener.

The second end 160*b* of the first web 160 corresponds to the second end of the first tensioner 148 and is removably connected to the first stake 150. Preferably, the first stake 150 has an upper portion 150*a* and a lower portion 150*b*. The upper portion 150*a* of the first stake 150 is an attachment that preferably is a loop 164 and the lower portion 150*b* of the first stake is a penetrator that preferably is a screw 166. The second end 160*b* of the first web 160 is removably connected to the first stake 150 by passing the first web 160 through the loop 164 and releasably securing the first web 160 to itself by a clasp 168 slideably attached to the first web 160 to allow for adjustment of the length of the first adjustable length 162 of the first link 154. While it is preferred that the first stake 150 be in the form of a screw 166, it is understood by those of ordinary skill in the art from this disclosure, that the stake could be of other configurations. For instance, the stake could be a simple tent stake where the ground conditions do not permit the easy insertion of the screw 166. Other alternatives to the screw 166, including nails, bolts, or any other suitable hardware having sufficient structural integrity to retain a position in the ground or other support structure (not shown).

The weather shield 110 has a second tensioner 170 having a first end and a second end. The first end of the second tensioner 170 is connected to the second end 116 of the sheet 112 and the second end of the second tensioner is connected to second stake 172. The second tensioner 170 and the second stake 172 are substantially the same as the first tensioner 148 and the first stake 150, respectively. Accordingly, for brevity, the second tensioner 170 and the second stake 172 will not be further discussed.

Referring to FIGS. 4 through 11, there is shown a second preferred embodiment of the transportable, rotatable weather shield, generally designated 10 and hereinafter referred to as the "weather shield" 10, in accordance with the present invention. The weather shield 10 includes a sheet 12 having a first end 16 and a second end 18 spaced from and opposed to the first end 16. Preferably, the first and second ends 16, 18 of the sheet 12 have a side panel 14 integral therewith. The side panels 14 preferably have the general shape of a semi-circle. The sheet 12 and the side panels 14 form a canopy having the general shape of a semi-cylinder with a generally semi-circular cross section and closed ends.

Figure 4:
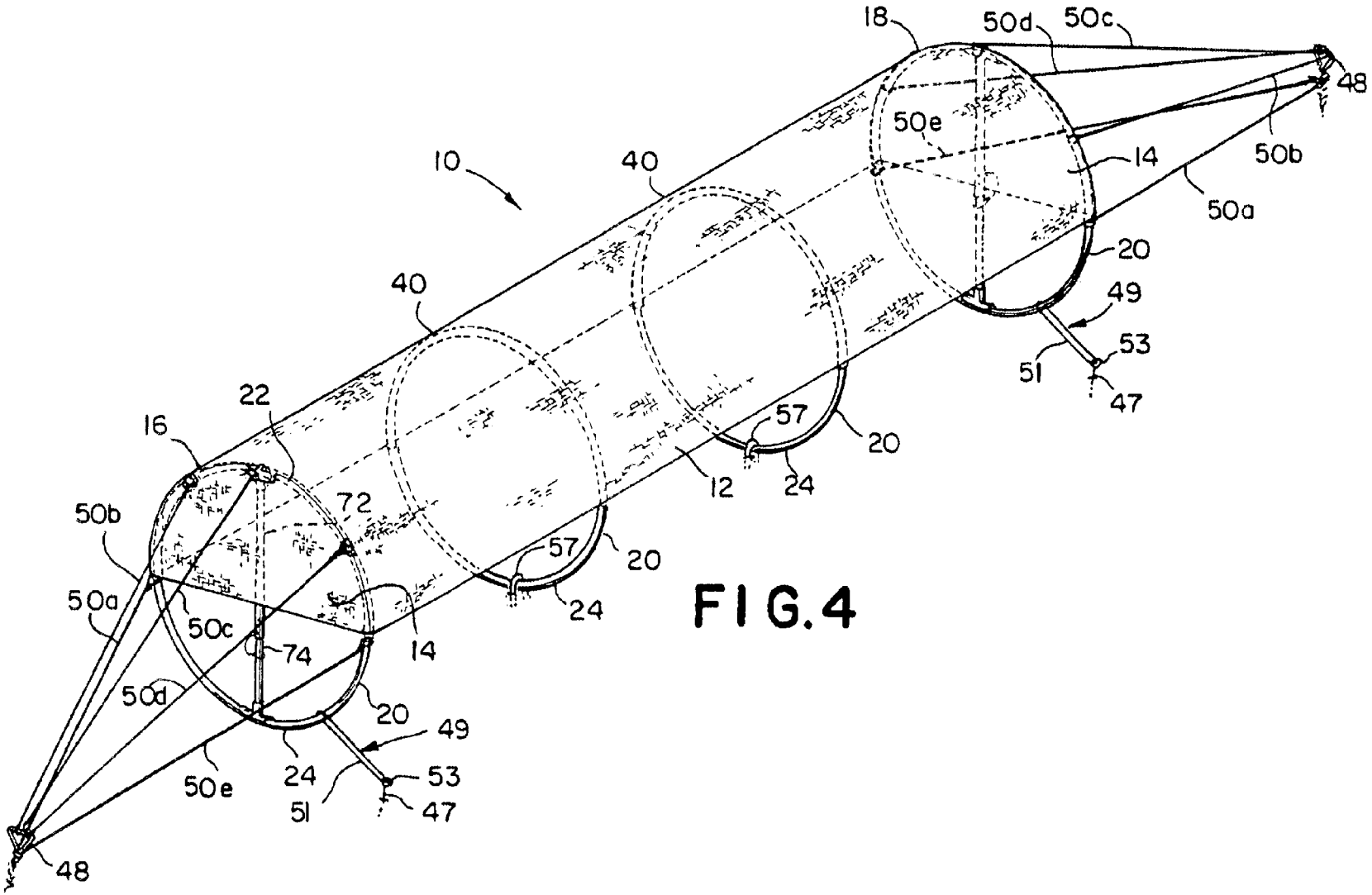
FIG. 4 is a perspective view of a transportable, rotatable weather shield in accordance with a second preferred embodiment of the present invention.
Figure 5:
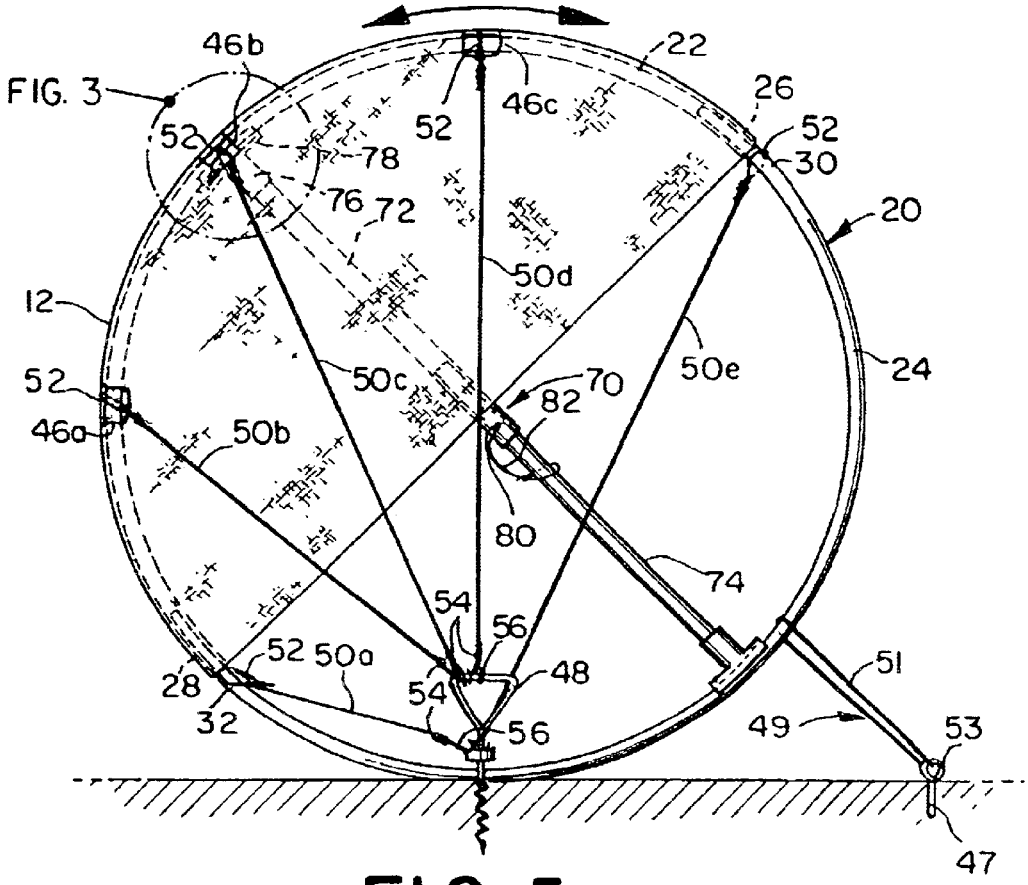
FIG. 5 is a left side elevational view of the weather shield of FIG. 4 rotated approximately forty-five (45) degrees counter clockwise.
Figure 6:
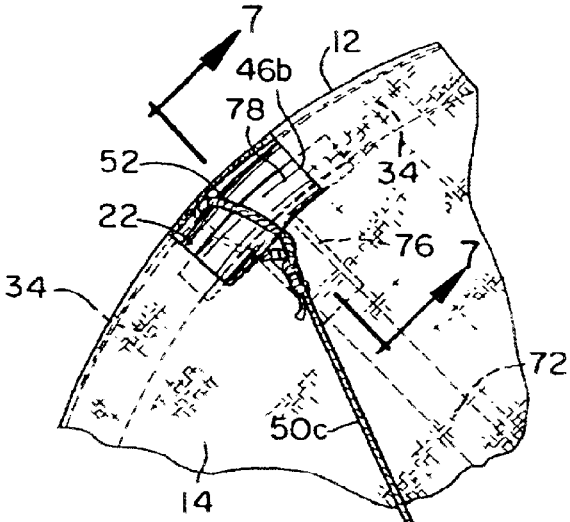
FIG. 6 is a greatly enlarged fragmentary view of a portion of the weather shield of FIG. 5 showing an upper end of an elastic member and an upper portion of an adjustable tubular support strut attached to an upper semi-hoop.
Figure 7:
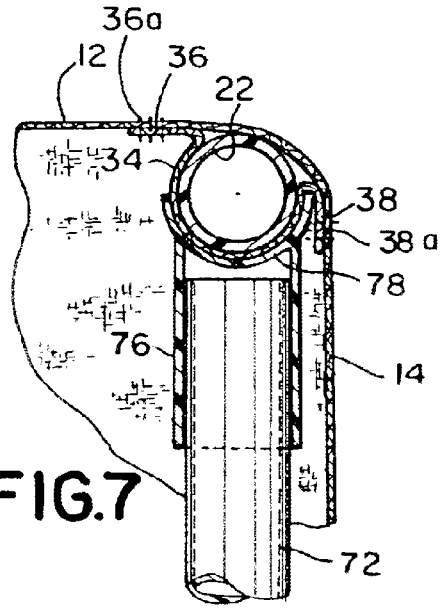
FIG. 7 is a partial cross-sectional view of the end of the weather shield taken along the lines 7—7 of FIG. 6.

Referring to FIGS. 4 and 6–7, preferably, the sheet 12 has end sleeves 34 having a first side 36 attached to the sheet 12 and a second side 38 attached to the side panels 14 by suitable stitching 36*a,* 36*b,* respectively. Those skilled in the art will recognize from the present disclosure that the side panels 14 may be removably attached to the sheet 12 by various fasteners such as snaps and zippers or may be removably attached directly by ties, rings or the like to the upper semi-hoops 22 discussed below. For such configurations, the second side 38 of the end sleeves 34 also is attached to the sheet 12. In the preferred embodiment, the sheet 12 has interior sleeves 40 equidistantly spaced from the first and second ends 16, 18 of the sheet 12 and from each other. The interior sleeves 40 have first and second sides (not shown) attached to the sheet 12 by suitable stitching (not shown).

Referring to FIGS. 4–7 and 10, the weather shield 10 has first and second supports having an upper portion and a generally arcuate-shaped lower portion. The upper portions of the first and second supports are connected respectively to the first and second ends 16, 18 of the sheet 12. Preferably the first and second supports are generally oval-shaped tubular hoops 20 having a plurality of separable segments. Preferably, the tubular hoops 20 have an upper semi-hoop 22 and a lower semi-hoop 24. The upper semi-hoops 22 have a smaller cross-sectional area than the lower semi-hoops 24. The upper semi-hoops 22 are attached to the sheet 12 by insertion into the end sleeves 34 and the interior sleeves 40, such that the first and second ends 26 and 28 of the upper semi-hoops 22 protrude from the end sleeves 34 and the interior sleeves 40.

Those skilled in the art will recognize from the present disclosure that the invention is not restricted to embodiments having the upper semi-hoops attached to the sheet 12 by end sleeves 34 and interior sleeves 40. Broadly, the upper semi-hoops 22 may be attached to the sheet 12 by other means of attachment such as straps, loops, and the like. Additionally, those skilled in the art will recognize that the interior sleeves 40 are not necessary unless the distance between the first and second ends 16, 18 of the weather shield 10 is sufficiently long to cause the sheet 12 to sag.

The upper and lower semi-hoops 22, 24 have an arc length larger than the arc length of a semi-circle, such that upon insertion of the first and second ends 26, 28 of the upper semi-hoops into the first and second ends 30, 32 of the corresponding lower semi-hoops, the combination forms substantially a circular shape. In the second preferred embodiment, the upper and lower semi-hoops 22, 24 have a circular cross section, the cross-sectional diameter of the upper semi-hoops 22 being approximately one-half inch and the cross-sectional diameter of the lower semi-hoops 24 being approximately one inch.

Those skilled in the art will recognize from the present disclosure that the invention is not restricted to embodiments having hoops 20 separable into only two segments. The artisan will understand that the upper and lower semi-hoops 22, 24 also may be separable into additional segments and that preferably, the upper and lower semi-hoops 22, 24 are each separable into two segments. Broadly, the tubular hoops 20 can be generally arcuate in shape and can be one or more pieces of any tubular material suitable for outdoor application.

Referring to FIGS. 4–7 and 8–9, the weather shield 10 has first and second stakes 48. The lower portion 58 of the stakes 48 has the general shape of a corkscrew. The center portion 60 of the stakes 48 is in the form of a straight vertical rod. The center portion 60 has a flange 62 fixedly attached thereto and a bushing 64 rotatable about the center portion 60. The bushing 64 has a ring 68 attached thereto. The upper portion 68 is triangular in shape.

The weather shield 10 has first and second tensioners, each of which has a first end and a second end. The first ends of the first and second tensioners are respectively connected to the first and second ends 16, 18 of the sheet and the second ends of the first and second tensioners are respectively connected to the first and second stakes 48. Preferably, the first and second tensioners comprise first, second, third, fourth and fifth elastic members 50*a,b,c,d,e.* The elastic members 50*a*–50*e* have a first end 52 and a second end 54 with hooks 56 attached thereto. The first ends 52 of the first and fifth elastic members 50*a,* 50*e* of the first and second tensioners, respectively, are fixedly attached to the first and second ends 26, 28 of the upper semi-hoops 22 protruding from the end sleeves 34 at the first and second ends 16, 18 of the sheet 12 by looping the upper ends 52 around the upper semi-hoops 22 and tying the upper ends 52 to themselves. The hooks 56 attached to the second ends 54 of the first and fifth elastic members 50*a,* 50*b* are removably attached to the rings 66 of the first and second stakes 48.

The first ends 52 of the second, third and fourth elastic members 50*b,c,d* of the first and second tensioners, respectively, pass through first, second and third cut-outs 46*a,b,c* (see FIGS. 5 and 6), respectively, in first and second ends 16, 18 of the sheet 12 and are fixedly attached to the upper semi-hoops 22 by looping the upper ends 52 around the upper-semi-hoops 22 and tying the upper ends 52 to themselves. The first, second and third cut-outs 46*a,b,c* are equidistantly spaced from each other and the first and second ends 26, 28 of the upper semi-hoops 22 inserted in the end sleeves 34. The hooks 56 attached to the second ends 54 of the second, third and fourth elastic members 50*b,c,d* are removably attached to the upper portions 68 of the first and second stakes 48. Those skilled in the art will recognize from the present disclosure that the manner in which the first ends 52 of the elastic members 50*a*–50*e* are attached to the upper semi-hoops 22 is not limited to a specific type of attachment and, alternatively, that the first ends 52 could be attached by a clamp, a hook, a ring, a pin, a screw, or the like. Similarly, the manner in which the second ends 54 of the elastic members 50*a*–50*e* are attached to the first and second stakes 48 is not limited to a specific type of attachment and, alternatively, that the second ends 54 could be attached by a latch, a split ring or the like. Those skilled in the art will recognize from the present disclosure that the number of elastic members may be more or less than five in number. The only requirement is that the number of elastic members be sufficient to keep the tubular hoops 20 at the first and second ends 16, 18 of the weather shield 10 substantially perpendicular to the longitudinal axis of the weather shield 10 when the weather shield 10 is errect.

Referring now to FIG. 4, those skilled in the art will recognize from the present disclosure that under extreme wind conditions wind anchors 49 may be required and typically would consist of elastic anchor straps 51 looped through the tubular hoops 20 at the first and second ends 16, 18 of the weather shield 10 and further attached to an eye 53 of spikes 47 driven into the ground on the windward side of the canopy. Additionally, hold-down anchors 57, generally in the shape of an inverted letter "U", positioned over one or more lower semi-hoops 24 and driven into the ground may be required to prevent the tubular hoops 20 passing through the interior sleeves 40 from lifting off the ground.

Referring to FIGS. 5–7 and 11, the tubular hoops 20 located at the first and second ends 16, 18 of the weather shield 10 have an adjustable support strut 70 separable into a upper strut 72 and a lower strut 74. The lower strut 74 is telescopically inserted in the upper strut 72. The upper and lower struts 72, 74 terminate in a T-shaped coupling 76 having an arcuate-shaped channel 78 having a contour that conforms to the contour of the upper and lower semi-hoops 22, 24. The adjustable tubular support strut 70 is movably attachable to the tubular hoop 20 by telescopically adjusting the length of the support strut 70 such that the arcuate-shaped channels 78 contact diametrically opposed portions of the hoop 20. A removable pin 80 attached to the upper portion 72 of adjustable strut 70 by a tie 82 is inserted in a hole 84 extending through the upper strut 72 of the support strut 70 to fix the support strut 70 in the extended position. Those skilled in the art will recognize from the present disclosure that the invention is not restricted to embodiments having the movably attachable support strut 70. Generally, a support strut is not necessary if the tubular hoops 20 are made from a material with limited compliance or alternatively, if the tubular hoops 20 are made from a compliant material, a fixedly attached or removable one-piece strut could be used.

Figure 12:
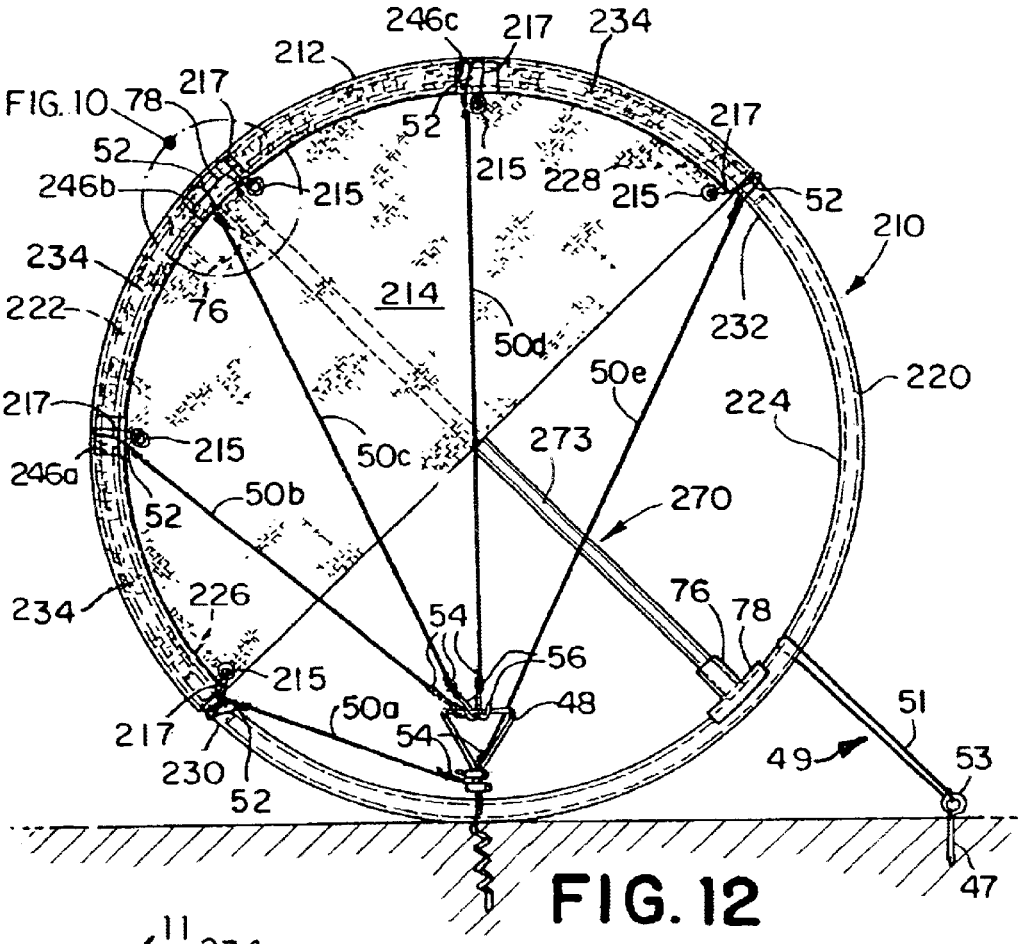
FIG. 12 is a left side elevational view of a third preferred embodiment of the weather shield rotated approximately forty-five (45) degrees counter clockwise.
Figure 13:
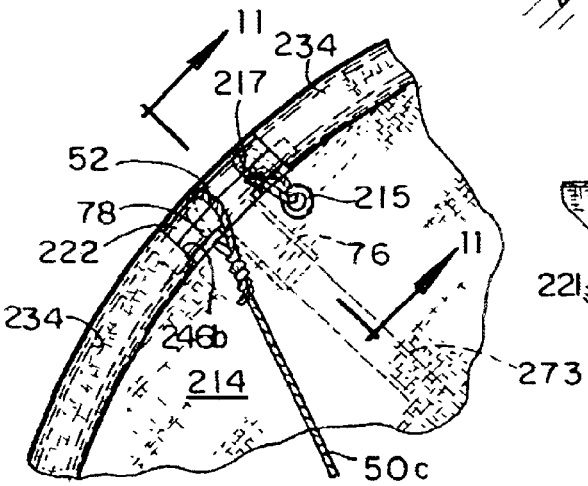
FIG. 13 is a greatly enlarged fragmentary view of a portion of the third preferred embodiment of the weather shield of FIG. 12 showing an upper end of an elastic member and an upper portion of a tubular support strut attached to an upper semi-hoop.
Figure 14:
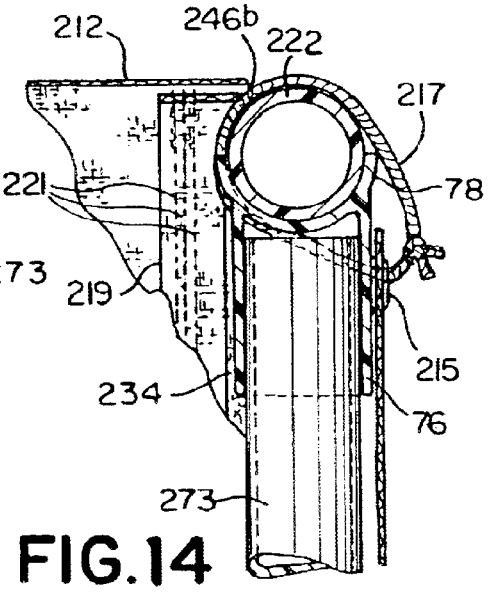
FIG. 14 is a partial cross-sectional view of the end of the third preferred embodiment of the weather shield taken along the lines 11—11 of FIG. 13.

In FIGS. 12–16 there is shown a third preferred embodiment of the transportable, rotatable weather shield, generally designated 210, and hereinafter referred to as the "weather shield" 210 having a sheet 212, side panels 214, hoops 220 and support struts 270 of a different design than the corresponding sheet 12, side panels 14, hoops 20 and support struts 70 of the second preferred embodiment of the weather shield 10. All other elements of the weather shield 210 of the third preferred embodiment are the same as the elements of the weather shield 10 of the second preferred embodiment and are indicated by like numerals. As shown in FIGS. 12–14, the sheet 212 has end sleeves 234 that are formed by folding over the ends 219 of the sheet 212 and by suitable stitching 221 attaching the ends 219 to the sheet 212. The end sleeves 234 have first, second, and third cut-outs 246*a, b,c* to permit the first ends 52 of the second, third and fourth elastic members 50*b,c,d* to pass therethrough and be fixedly attached to the upper semi-hoops 222.

The weather shield 210 has side panels 214, generally in a semi-circular shape, at the first and second ends 16, 18 of the weather shield 210. Each side panel 214 has five grommets 215 equidistantly spaced along the arcuate shaped portion of its perimeter for removably attaching the side panel 214 to the hoops 220 at the first and second ends 16, 18 of the weather shield 210 by passing a side panel tie 217 through the grommet and tying the tie 217 around the hoops 220 adjacent to the points of attachment of the elastic members 50*a*–*e* to the hoops 220.

Figure 15:
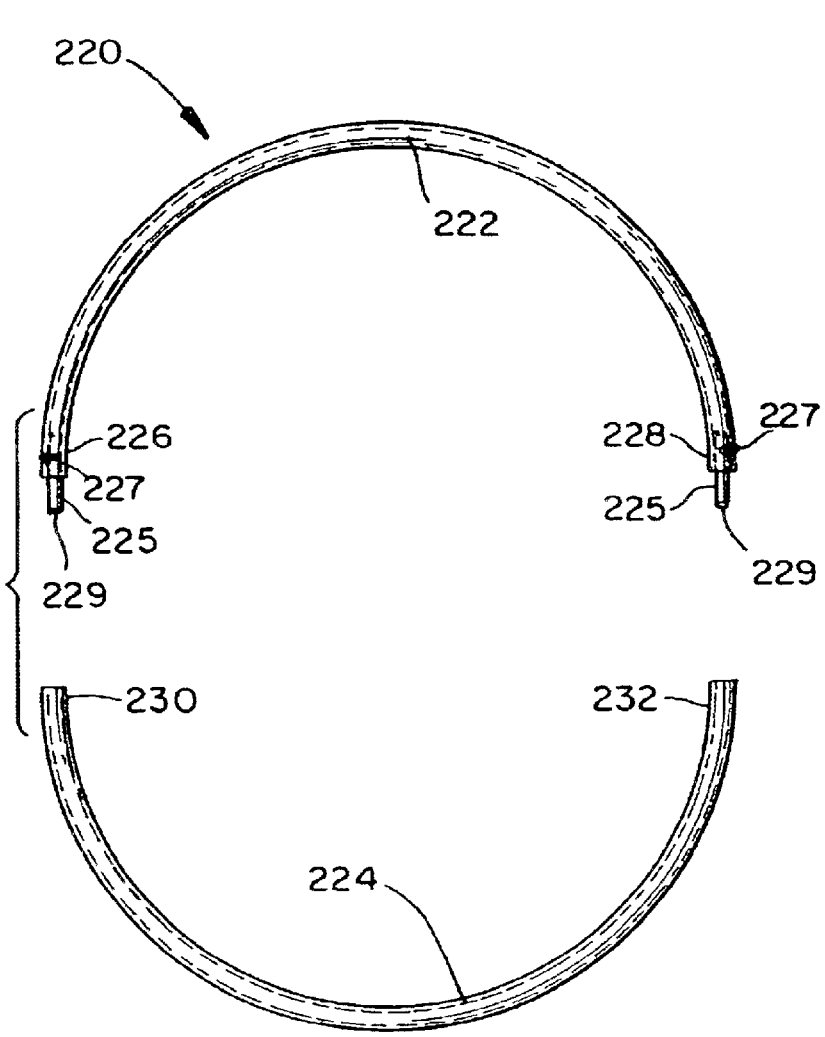
FIG. 15 is an enlarged, left side elevational view of an exploded hoop of the third preferred embodiment.

Referring to FIGS. 12 and 15, the sheet 212 and the side panels 214 are supported by tubular hoops 220 in the general shape of a circle. The tubular hoops 220 have an upper semi-hoops 222 and a lower semi-hoop 224 having a generally circular cross-section approximately three-quarter inch in diameter. The first and second ends 226, 228 of the upper semi-hoop 222 have pegs 225 inserted approximately half its length therein and attached to the semi-hoop by screws 227. The protruding ends 229 of the pegs 225 are insertable into the first and second ends 230, 232 of the lower semi-hoop 224 to form the tubular hoops 220.

Figure 16:
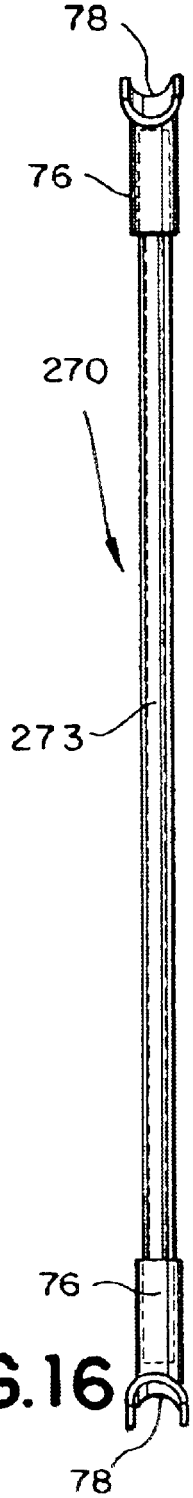
FIG. 16 is an enlarged elevational view of a support strut of the third preferred embodiment.

Referring to FIGS. 12, 15, and 16, the tubular hoops 220 located at the first and second ends 16, 18 of the weather shield 210 have a support strut 270. The support struts 270 have a single tubular member 273 and T-shaped couplings 76 at each end. The support struts 270 are movably attachable to the tubular hoops 220 by slightly distorting the circular shape of the hoops 220, such that upon insertion of the support strut 270 and the return of the hoops 220 to their circular shape, the arcuate shaped channels 78 of the T-shaped couplings 76 contact diametrically opposed portions of the hoops 220.

The weather shield 110 of the first preferred embodiment is stored and transported partially disassembled. The first and second stakes 150, 172 are detached from the first and second tensioners 148, 170, respectively. The upper portions 138, 144 and lower portions 140, 146 of the first and second supports 136, 142, respectively, are separated and the upper portions 138, 144 are removed from the first and second sleeves 118, 124, respectively. If the upper and lower portions 138, 144, 140, 146 are further separable, they may be separated into smaller segments for ease of transport and storage. Additional supports, if any, are similarly removed and separated from their respective sleeves. The sheet 112 may be folded for transport and storage with the first and second tensioners attached.

In use, the weather shield 110 is transported to a desired location on a playing field and assembled by connecting together the segments, if any, of the upper portions 138, 144 of the first and second supports 136, 142 and inserting the upper portions 138, 144 into the first and second sleeves 118, 124 at the first and second ends 114, 118 of the sheet 112. The segments if any, of the lower portions 140, 146 of the first and second supports 136, 142 are connected and then the lower portions 140, 146 are connected to the upper portions 138, 144 of the first and second supports 136, 143. Additional supports are similarly assembled and inserted in the corresponding sleeves of the sheet 112. The sheet 112 and the first and second tensioners 148, 170 are extended their full longitudinal length.

The first stake 150 is positioned at the end of the first tensioner 148 and driven into the ground by rotating the stake 150 such that the lower screw-like portion 150*b* of the stake 150 penetrates the ground to a desired depth. The second end 160*b* of the first web 160 corresponding to the second end of the first tensioner 148 is connected to the upper portion 150*b* of the first stake 150 by passing the first web 160 through the loop 164 of the first stake 150 and securing the first web 160 to itself by a clasp 168 slideably attached to the first web 160. A similar procedure is followed for the second stake 172 and the second tensioner 170. The location of the second stake 172 is identified by stretching the first and second tensioners 148, 170 and the weather shield 110 while the weather shield 110 and first and second tensioners 148, 170 are on the ground.

The weather shield 110 is erected by raising the first and second supports 136, 142 to a vertical position and similarly raising any additional supports. Upon raising the supports, the first and second tensioners 148, 170 place the sheet 112 in tension due to the stretch induced in the elastic members 152 and the weather shield 110 becomes a compliant structure. The tension in the sheet 112 can be increased or decreased as desired by adjusting the tension of either the first or second tensioners 148, 170 or both. The tension in the first tensioner 148 can be adjusted by increasing or decreasing the length of the first adjustable length 162 of the first link 154 connecting the elastic members 152 to the first stake 150. The tension in the second tensioner 170 can be similarly adjusted.

The position of the weather shield 110, as depicted in FIG. 1, is the preferred orientation for protection from the sun when the sun is positioned at high noon, or in response to rain or wind. Referring to FIG. 2, the position of sheet 112 is adjustable by an angular displacement of the first and second supports 136, 142 and any other supports therebetween. As the position of the sun changes, the shadow cast by the weather shield 110 can be changed by rotating the weather shield 110 to any desired position, which may include a rotation that positions the sheet 112 approximately one-foot above the ground, as this position is known to improve natural air circulation beneath the sheet 112.

The weather shield 10 of the second preferred embodiment is stored and transported partially assembled. The first and second stakes 48 are detached from the elastic members 50*a* 50*e*, the adjustable support struts 70 are telescopically collapsed and removed from the tubular hoops 20 at the first and second ends 16, 18 of the weather shield 10, and the lower semi-hoops 24 are separated from the upper semi-hoops 22. The sheet 12 is collapsed with the upper semi-hoops 22 remaining in the end and interior sleeves 34, 40. The upper ends 52 of the elastic members 50*a*–50*e* remain attached to the upper semi-hoops 22. The weather shield 210 of the third preferred embodiment is similarly stored, except that the support strut 270 cannot be telescopically collapsed and the side panels 214 may be removed.

In use, the weather shield 10 is assembled by inserting the first and second ends 26, 28, respectively, of the upper semi-hoops 22 into the first and second ends 30, 32 of the lower semi-hoops 24 and extending the sheet 12 to its full length. The first and second stakes 48 are screwed into the ground at a location spaced apart from the first and second ends 16, 18 of the sheet 12, such that the tubular hoops 20 will be placed in compression and the sheet 12 will be placed in tension by the first and fifth elastic members 50*a*, 50*e* attached by the hooks 56 to the rings 66 attached to the first and second stakes 48 and by the second, third and fourth elastic members 50*c*, 50*c*, 50*d* attached by the hooks 56 to the upper portion 68 of the first and second stakes 48, when the hoops 20 are positioned vertically. The first and second stakes 48 preferably are placed at a distance from the first and second ends 16, 18 of the weather shield approximately equal to the diameter of the hoops 20. The adjustable tubular support struts 70 are attached to the tubular hoops 20 at the first and second ends 16, 18 such that the arcuate-shaped channel 78 of the T-shaped couplings 76 of the upper struts 72 is equidistantly spaced from the first and second ends 26, 28 of the upper semi-hoops 22. The adjustable tubular support struts 70 are telescopically extended along a diameter of the tubular hoops 20 until the arcuate-shaped channel 78 of the lower strut 74 contacts the lower semi-hoop 24 and places the support strut 70 in compression. To prevent the support strut 72 from telescopically collapsing, the pin 80 is inserted in the hole 84 in the upper strut 72. As initially erected, the support struts 70 will be in a vertical position, the tubular hoops 20 will be held in place by frictional contact with the ground and the weather shield 10 will appear as illustrated in FIG. 4. Under high wind conditions, the weather shield 10 may be more securely anchored by fixing one or more hoops 20 to the ground with wind anchors 47 or hold down anchors 57.

Figure 8:
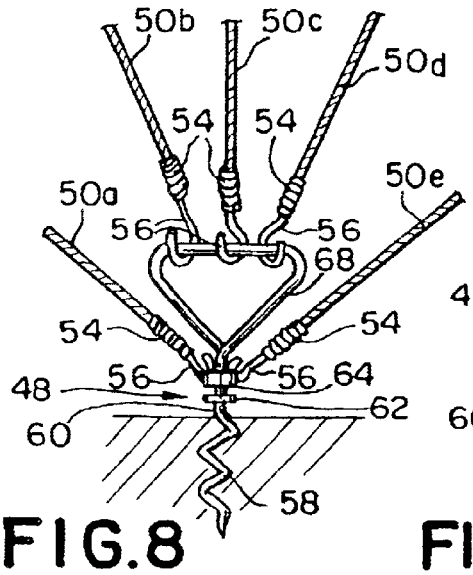
FIG. 8 is a left side elevational view, partially in cross-section, of an anchor showing the attachment of hooks attached to the lower end of the elastic members of the weather shield of FIG. 4.
Figure 9:
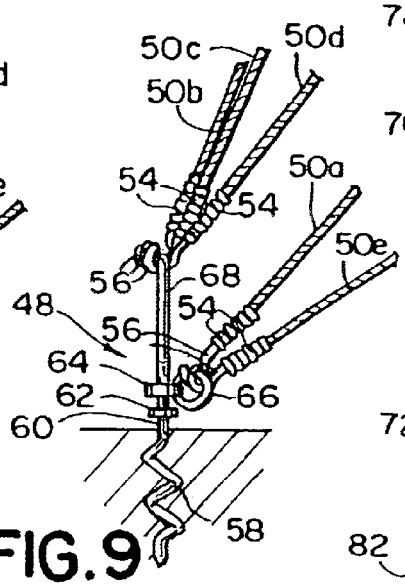
FIG. 9 is a front elevational view, partially in cross-section, of the anchor of FIG. 8.
Figure 10:
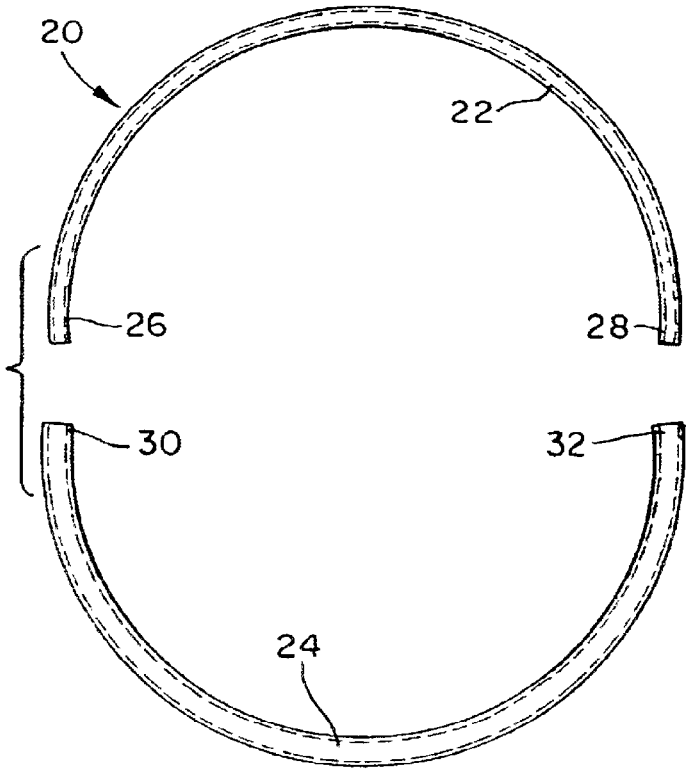
FIG. 10 is an enlarged, left side elevational view of an exploded hoop of the second preferred embodiment.
Figure 11:
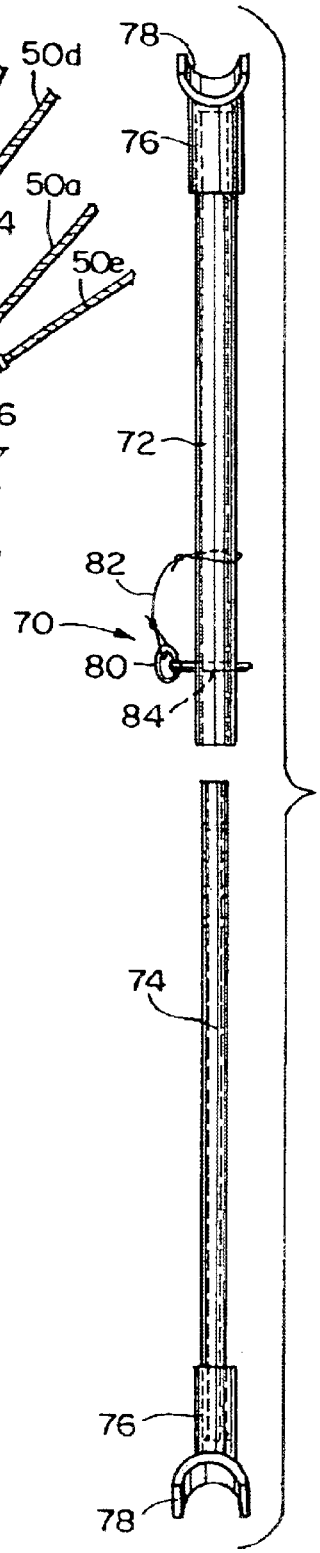
FIG. 11 is an enlarged elevational view of an exploded support strut of the second preferred embodiment.

The position of the weather shield 10, as depicted in FIG. 4, is the preferred orientation for protection from the sun when the sun is positioned at high noon. Referring to FIG. 8, as the position of the sun changes, the shadow cast by the sheet 12 can be changed by rotating the tubular hoops 20 to a desired position, which may include a rotation that positions the sheet 12 approximately one-foot above the ground, as this position is known to improve natural air circulation beneath the sheet 12. Due to frictional forces between the tubular hoops 20 and the ground, the support struts 70 may remain inclined from the vertical after the tubular hoops 20 are rotated. However, the support struts 70 may be repositioned to a desired inclination, including vertical, by telescopically collapsing, rotating and re-extending the support struts 70.

When the weather shield 10 is alternatively used as a billboard, or concurrently used both as a billboard and a shield, the aforementioned storage and assembly discussion equally apply. When the weather shield 10 is used as a billboard, the sheet 12 includes a surface area where advertising is permanently placed through standard inking processes, such as ink jet printing, silk screening or other suitable permanent printing methods. The surface area is defined as the external surface of the sheet 12 which forms the external semi-cylindrical surface of the weather shield 10. However, if the message to be communicated is not permanently affixed to the sheet 12, the medium bearing the message should be removably attached to the sheet 12 by an appropriate manner of fastening, such as snaps, tape, adhesives or the like, after the weather shield 10 is assembled and removed before the weather shield 10 is disassembled for transportation and storage. The weather shield 10 is preferably sized to correspond to the dimensions of a standard 12 ounce aluminum can used for dispensing beverages, such as soda, beer, ice tea, etc. This permits such beverage companies to readily advertised on the weather shield 10 with their standard can-sized dimensional graphics, such as Coca-Cola. This paragraph applies to all of the preferred embodiments.

The storage, transportation and use of the weather shield 210 of the third preferred embodiment are substantially the same as the weather shield 10 of the second preferred embodiment. The noteworthy differences are that the side panels 214 are removable from the hoops 220 and the support struts 270 are not telescopic.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A transportable weather shield for erection in close proximity to a sideline of a playing field, the transportable weather shield comprising:

a sheet having a first end, a second end, a first edge, and a second edge, the second end spaced from and opposed to the first end, the first edge and the second edge extending between the first end and the second end, the second edge spaced from the first edge:

a first tubular hoop having a circular shape and a circular cross-section, the first tubular hoop having an upper portion and a lower portion, the upper portion of the first tubular hoop connected to the first end of the sheet, the lower portion of the first tubular hoop resistive to flattening;

a first tensioner having a first end and a second end, the first end of the first tensioner connected to the first end of the sheet;

a first stake connected to the second end of the first tensioner;

a second tubular hoop having a circular shape and a circular cross-section, the second tubular hoop having an upper portion and a lower portion, the upper portion of the second tubular hoop connected to the second end of the sheet, the lower portion of the second tubular hoop resistive to flattening:

a second tensioner having a first end and a second end, the first end of the second tensioner connected to the second end of the sheet; and a second stake connected to the second end of the second tensioner, the weather shield forming a complaint structure, the sheet having a shape corresponding to a portion of the surface of circular cylinder, the first and second edges of the sheet defining opposed sides of a rectangular opening providing a generally unobstructed view of the playing field, and a position of the sheet being adjustable by an angular displacement of the first and second tubular hoops, upon erection of the first and second tubular hoops and tensioning of the first and second tensioners, wherein:

the first end of the sheet has a first sleeve containing the upper portion of the first tubular hoop, a first plurality of spaced-apart tabs is peripheral to the first sleeve, and each tab of the first plurality of spaced-apart tabs has a grommet; and the second end of the sheet has a second sleeve containing the upper portion of the second tubular hoop, a second plurality of spaced-apart tabs is peripheral to the second sleeve, and each tab of the second plurality of spaced-apart tabs has a grommet.

2. A transportable weather shield for erection in close proximity to a sideline of a playing field, the transportable weather shield comprising:

a sheet having a first end, a second end, a first edge, and a second edge, the second end spaced from and opposed to the first end, the first edge and the second edge extending between the first end and the second end, the second edge spaced form the first edge;

a first tubular hoop having a circular shape and a circular cross-section, the first tubular hoop having an upper portion and a lower portion, the upper portion of the first tubular hoop connected to the first end of the sheet, the lower portion of the first tubular hoop resistive to flattening;

a first tensioner having a first end and a second end, the first end of the first tensioner connected to the first end of the sheet;

a first stake connected to the second end of the first tensioner;

a second tubular hoop having a circular shape and a circular cross-section, the second tubular hoop having an upper portion and a lower portion, the upper portion of the second tubular hoop connected to the second end of the sheet, the lower portion of the second tubular hoop resistive to flattening;

a second tensioner having a first end and a second end, the first end of the second tensioner connected to the second end of the sheet; and a second stake connected to the second end of the second tensioner, the weather shield forming a complaint structure, the sheet having a shape corresponding to a portion of the surface of circular cylinder, the first and second edges of the sheet defining opposed sides of a rectangular opening providing a generally unobstructed view of the playing field, and a position of the sheet being adjustable by an angular displacement of the first and second tubular hoops, upon erection of the first and second tubular hoops and tensioning of the first and second tensioners, wherein:

the first end of the sheet has a first sleeve and a first plurality of spaced-apart tabs peripheral to the first sleeve, each tab of the first plurality of spaced-apart tabs having a grommet, the second end of the sheet has a second sleeve and a second plurality of spaced-apart tabs peripheral to the first sleeve, each tab of the second plurality of spaced-apart tabs having a grommet;

the upper portion of the first tubular hoop is contained in the first sleeve, the first tubular hoop comprising a first plurality of separable segments;

the first tensioner comprises a first link and a first plurality of elastic members, the first link comprising a first ring and a first web having a first end and a second end spaced an adjustable first length from the first end, the first end being connected to the first ring, each elastic member of the first plurality of elastic members having a first end and a second end, the first end of each elastic member removably connected to the grommet of a corresponding tab of the first plurality of spaced-apart tabs peripheral to the first sleeve of the first end of the sheet, the second end of each elastic member removably connected to the first ring of the first link;

the first stake is removably connected to the second end of the first web of the first link;

the upper portion of the second tubular hoop is contained in the second sleeve, the second tubular hoop comprising a second plurality of separable segments;

the second tensioner comprises a second link and a second plurality of elastic members, the second link comprising a second ring and a second web having a first end and a second end spaced an adjustable second length from the first end, the first end being connected to the second ring, each elastic member of the second plurality of elastic members having a first end and a second end, the first end of each elastic member removably connected to the grommet of a corresponding tab of the second end of the sheet, the second end of each elastic member removably connected to the second ring of the second link; and the second stake is removably connected to the second end of the second web of the second link.

3. The transportable weather shield according to claim 2 further comprising:

a canopy in the general shape of a semi-cylindrical surface, the canopy formed by the sheet, a first side panel having the general shaped of semi-circle, the first side panel integral with the first end of the sheet and a second side panel having the general shape of a semi-circle, the second side panel integral with the second end of the sheet.

4. The transportable weather shield according to claim 3 wherein the first and second side panels are removably attached to the sheet.

5. The transportable weather shield according to claim 2 further comprising:

a third sleeve integral with the sheet, the third sleeve spaced between the first and second sleeves; and a third tubular hoop having a circular shape and a circular cross-section, the third tubular hoop having an upper portion and a lower portion, the upper portion of the third tubular hoop being in the third sleeve, the lower portion of the third tubular hoop resistive to flattening.

6. The transportable weather shield according to claim 5 further comprising:

a first strut removably connected to the first support, the first strut extending form the upper portion of the first support to the lower portion of the first support; and a second strut removably connected to the second support, the second strut extending form the upper portion of the second support to the lower portion of the second support.

* * * * *